US007726583B2

(12) United States Patent
Maekawa

(10) Patent No.: US 7,726,583 B2
(45) Date of Patent: Jun. 1, 2010

(54) SEPARATE TYPE AIR CONDITIONER

(75) Inventor: Yasunori Maekawa, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 755 days.

(21) Appl. No.: 11/662,069

(22) PCT Filed: Sep. 9, 2005

(86) PCT No.: PCT/JP2005/016593

§ 371 (c)(1),
(2), (4) Date: Mar. 7, 2007

(87) PCT Pub. No.: WO2006/030704

PCT Pub. Date: Mar. 23, 2006

(65) Prior Publication Data

US 2007/0251250 A1 Nov. 1, 2007

(30) Foreign Application Priority Data

Sep. 14, 2004 (JP) ..... 2004-266832

(51) Int. Cl.
*G05D 23/00* (2006.01)
*F25B 49/00* (2006.01)

(52) U.S. Cl. ..... 236/51; 340/310.11; 361/622; 62/132

(58) Field of Classification Search ..... 236/51; 62/132, 175; 340/310.11; 361/622, 627–632
See application file for complete search history.

(56) References Cited

U.S. PATENT DOCUMENTS 5,878,584 A * 3/1999 Sasaki et al. ..... 62/115
7,308,384 B2 * 12/2007 Shah et al. ..... 702/183
2005/0145705 A1 * 7/2005 Shah et al. ..... 236/51

FOREIGN PATENT DOCUMENTS

JP 09-1-33412 A 5/1997
JP 3019844 B1 3/2000

* cited by examiner

*Primary Examiner*—Frantz F. Jules
*Assistant Examiner*—Daniel C Comings
(74) *Attorney, Agent, or Firm*—Global IP Counselors

(57) ABSTRACT

An indoor unit has first, second indoor side terminals to which first, second interconnection lines respectively, are connected at their one end, a third indoor side terminal to which a third interconnection line is connected at its one end, a relay with one end connected to the second indoor side terminal and another end connected to the third indoor side terminal, and a CPU. The outdoor unit has first, second outdoor side terminals as outdoor side power-receiving terminals to which the first, second interconnection lines, respectively, are connected at their other end, a third outdoor side terminal to which the third interconnection line is connected at its other end, and an outdoor control section to which electric power is supplied via the first, third outdoor side terminals. The CPU of the indoor unit turns off the switch part in the standby state.

2 Claims, 3 Drawing Sheets

SEPARATE TYPE AIR CONDITIONER

CROSS-REFERENCE TO RELATED APPLICATIONS

This U.S. National stage application claims priority under 35 U.S.C. §119(a) to Japanese Patent Application No. 2004-266832, filed in Japan on Sep. 14, 2004, the entire contents of which are hereby incorporated herein by reference.

TECHNICAL FIELD

The present invention relates to a separate type air conditioner.

BACKGROUND ART

A first one of separate type air conditioners of the prior art is an outdoor power-receiving type one shown in FIG. 3. This separate type air conditioner includes an indoor unit 210 having an indoor control section 211, and an outdoor unit 220 having an outdoor control section 221. Electric power is fed from a power supply 230 via a terminal block 222 (terminals 222*a*, 222*b*) of the outdoor unit 220. Then, via the terminal block 222 (terminals 222*a*, 222*b*) of the outdoor unit 220, power-supply use interconnection lines L201, L202, and a terminal block 214 (terminals 214A, 214B) of the indoor unit 210, electric power is fed from the power supply 230 to the indoor unit 210. The indoor control section 211 of the indoor unit 210 and the outdoor control section 221 of the outdoor unit 220 are communicated with each other via the terminal block 214 (214C), a communication use interconnection line L203, and the terminal block 222 (222*c*).

The separate type air conditioner of this constitution has a drawback that it is impossible to stop the power supply to the outdoor unit 220 while the indoor unit 210 alone keeps being powered for convenience of indoor-side operation in order to meet power consumption regulations in the standby state.

Therefore, the present inventor has proposed a separate type air conditioner which is capable of reducing the standby power consumption by interrupting the power supply to the standby-state outdoor unit side, whichever the power supply from the external is connected to the indoor unit or the outdoor unit (see, e.g., JP 3019844 B1).

However, the separate type air conditioner, which interrupts the power supply to the standby-state outdoor unit side, has a need for a control board and a relay different in specifications from the normal indoor power-receiving system so as to provide also for the outdoor power-receiving system, causing the parts count to increase so that the structure becomes more complex. Moreover, there is a need for incorporating complex processing into the control program on the outdoor unit side, so that the manufacturing cost and development cost becomes higher, disadvantageously.

SUMMARY OF THE INVENTION

Accordingly, an object of the present invention is to provide a separate type air conditioner which is capable of stopping power supply on the outdoor unit side in the standby state while power is being received on the outdoor unit side, with simple construction and low cost.

In order to achieve the above object, there is provided a separate type air conditioner in which an indoor unit and an outdoor unit are connected to each other via power-supply use interconnection lines and a signal use interconnection line, wherein the power-supply use interconnection lines are a first interconnection line, a second interconnection line and a third interconnection line, and wherein the indoor unit comprises: first, second indoor side terminals as indoor side power-receiving terminals to which the first, second interconnection lines, respectively, are connected at their one end; a third indoor side terminal to which the third interconnection line is connected at its one end; a fourth indoor side terminal to which the signal use interconnection line is connected at its one end; a switch part whose one end is connected to the second indoor side terminal and whose other end is connected to the third indoor side terminal; and a control section for controlling the switch part so as to turn off the switch part in a standby state in which the outdoor unit is kept out of operation, the outdoor unit comprises: first, second outdoor side terminals as outdoor side power-receiving terminals to which the first, second interconnection lines, respectively, are connected at their other end; a third outdoor side terminal to which the third interconnection line is connected at its other end; and a fourth outdoor side terminal to which the signal use interconnection line is connected at its other end, and electric power is supplied to the indoor unit via the first indoor side terminal and the second indoor side terminal while electric power is supplied to the outdoor unit via the first outdoor side terminal and the third outdoor side terminal.

In the separate type air conditioner of this constitution, for example when the outdoor power-receiving system is adopted, power lines from an external power supply are connected to the first, second outdoor side terminals as outdoor side power-receiving terminals of the outdoor unit. As a result, the external power supply is connected to the first, second indoor side terminals of the indoor unit via the first, second outdoor side terminals of the outdoor unit and the first, second interconnection lines. The indoor unit is supplied with power from the first indoor side terminal and the second indoor side terminal, which are indoor side power-receiving terminals. Then, when the switch part is turned on by the control section for air-conditioning operation, the second indoor side terminal and the third indoor side terminal are connected to each other via the switch part, and one of the power lines of the external power supply is now connected to the third outdoor side terminal via the second outdoor side terminal, the second interconnection line, the second indoor terminal block, the switch part, the third indoor side terminal and the third interconnection line. Meanwhile, the other of the power lines of the external power supply is connected to the first outdoor side terminal as it is, so that electric power is supplied to the outdoor unit via the first outdoor side terminal and the third outdoor side terminal. After a stop of the air-conditioning operation, the switch part is turned off by the control section in a standby state in which the outdoor unit is stopped from operating. Then, the power supply to the outdoor unit is interrupted, so that electric power is supplied only to the indoor unit. Therefore, with simple construction and low cost, the power supply on the outdoor unit side can be stopped in the standby state while the power is received on the outdoor unit side.

In addition, when the indoor power-receiving system is adopted in the separate type air conditioner, power lines from the external power supply are connected to the first, second indoor side terminals as indoor side power-receiving terminals of the indoor unit. As a result, one of the power lines of the external power supply is connected to the first outdoor side terminal of the outdoor unit via the first indoor side terminal of the indoor unit and the first interconnection line.

The other of the power lines is connected to the third outdoor side terminal of the outdoor unit via the second indoor side terminal of the indoor unit, the switch part, the third indoor side terminal and the third interconnection line. In this case, processing for the standby state in which the outdoor unit is stopped from operating is performed in the same manner as in the outdoor power-receiving system, involving no need for changes in the control board and the control program.

In one embodiment of the invention, the switch part (13) does not consume electric power in its off state.

In the separate type air conditioner of this embodiment, the switch part that has been turned off by the control section in the standby state in which the outdoor unit is stopped from operating does not consume electric power. Thus, the standby power consumption can be further reduced.

As apparent from the above description, according to the separate type air conditioner of the present invention, in the standby state, while the power is received on the outdoor unit side, the power supply to the outdoor unit can be stopped by control from the indoor unit side, with simple construction and low cost.

DETAILED DESCRIPTION OF THE INVENTION

Hereinbelow, a separate type air conditioner of the present invention will be described in detail by way of embodiment thereof illustrated in the accompanying drawings.

Figure 1:
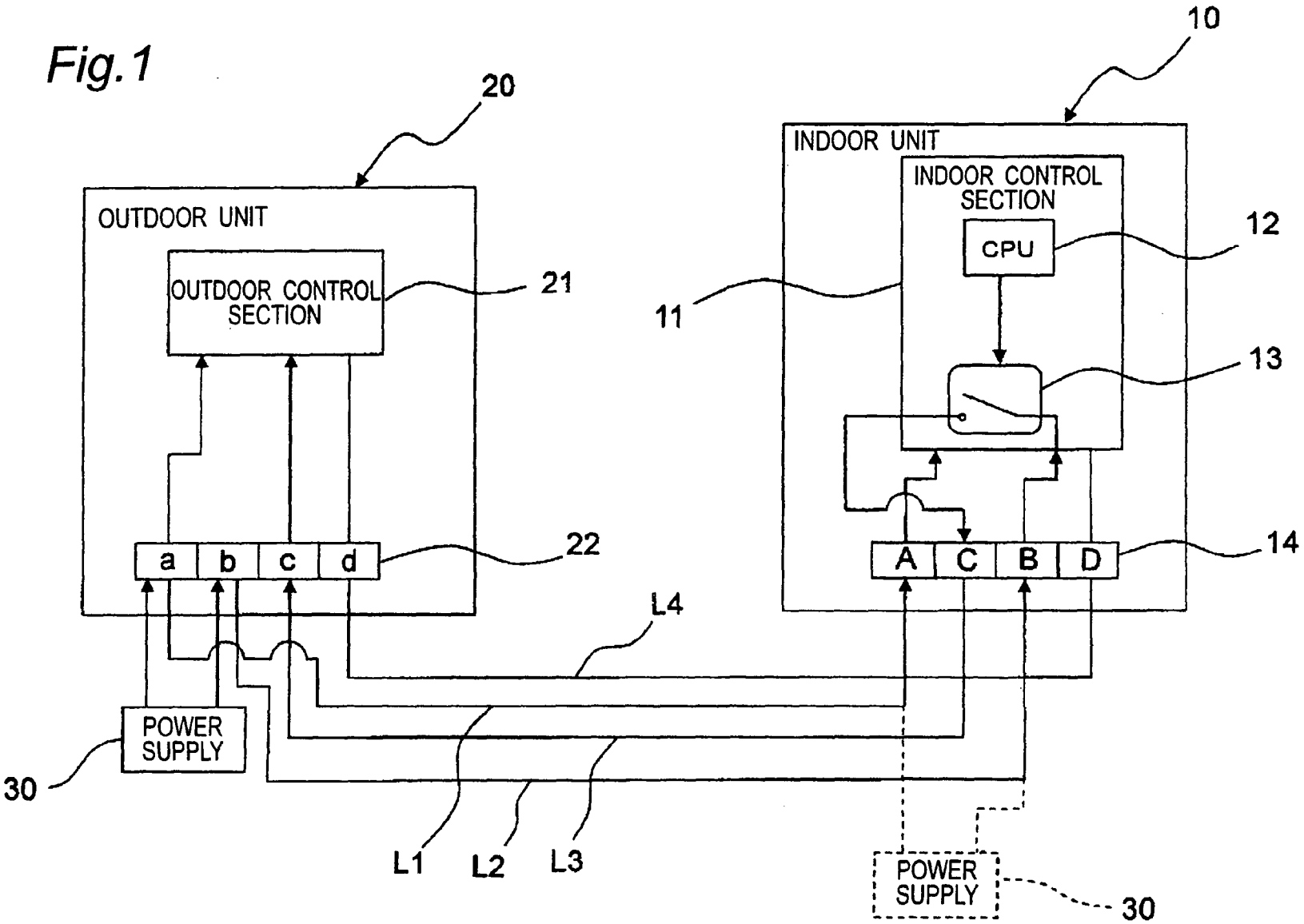
FIG. 1 is a configuration diagram of a separate type air conditioner which is one embodiment of the present invention.

FIG. 1 shows the configuration of a separate type air conditioner which is one embodiment of the invention. This separate type air conditioner, as shown in FIG. 1, includes an indoor unit 10 and an outdoor unit 20. An indoor terminal block 14 of the indoor unit 10 and an outdoor terminal block 22 of the outdoor unit 20 are connected to each other via three interconnection lines L1-L3, which are power-supply use interconnection lines, and a signal use interconnection line L4.

The indoor unit 10 has first, second indoor side terminals 14A, 14B to which the first, second interconnection lines L1, L2, respectively, are connected at their one end, a third indoor side terminal 14C to which a third interconnection line L3 is connected at its one end, a fourth indoor side terminal 14D to which the signal use interconnection line L4 is connected at its one end, and an indoor control section 11 to which electric power is supplied via the first, second indoor side terminals 14A, 14B.

The indoor control section 11 has a relay 13 as an example of a switch part whose one end is connected to the second indoor side terminal 14B and whose other end is connected to the third indoor side terminal 14C, and a CPU (Central Processing Unit) 12 as an example of a control part for turning on and off the relay 13. By the CPU 12, the relay 13 is turned off in a standby state in which the outdoor unit 20 is stopped from operating.

Meanwhile, the outdoor unit 20 has first, second outdoor side terminals 22*a*, 22*b* to which the first, second interconnection lines L1, L2, respectively, are connected at their other end, a third outdoor side terminal 22*c* to which the third interconnection line L3 is connected at its other end, a fourth outdoor side terminal 22*d* to which the signal use interconnection line L4 is connected at its other end, and an outdoor control section 21 to which electric power is supplied via the first outdoor side terminal 22*a* and the third outdoor side terminal 22*c*. Power lines of a power supply 30 are connected to the first, second outdoor side terminals 22*a*, 22*b*, which are outdoor side power-receiving terminals (when the indoor power-receiving system is adopted, power lines of the power supply 30 are connected to the first, second indoor side terminals 14A, 14B, which are indoor side power-receiving terminals).

The indoor control section 11 of the indoor unit 10 and the outdoor control section 21 of the outdoor unit 20 are communicated with each other via the signal use interconnection line L4.

Figure 2:
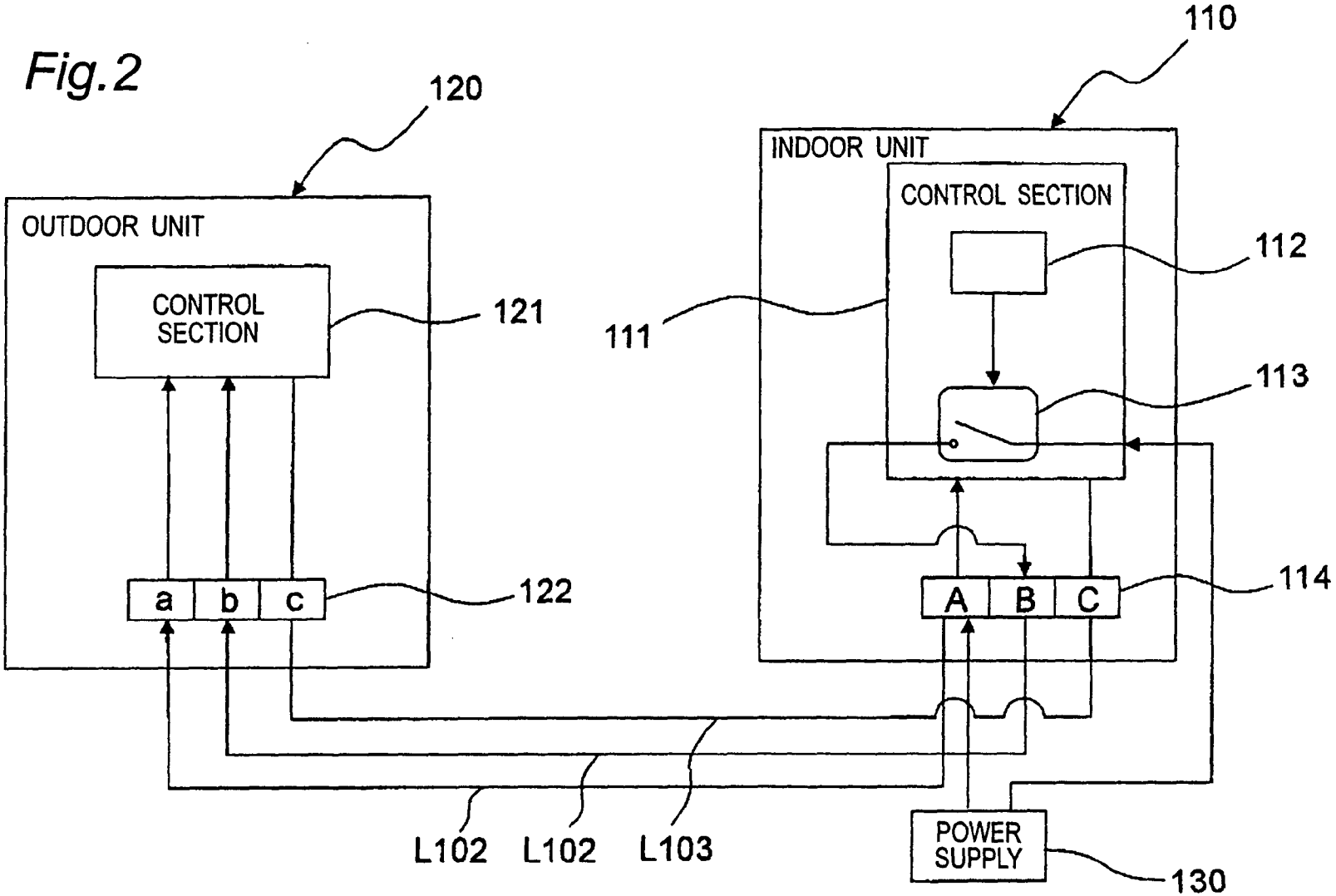
FIG. 2 is a configuration diagram of a separate type air conditioner which is a comparative example for comparison with the above separate type air conditioner.
Figure 3:
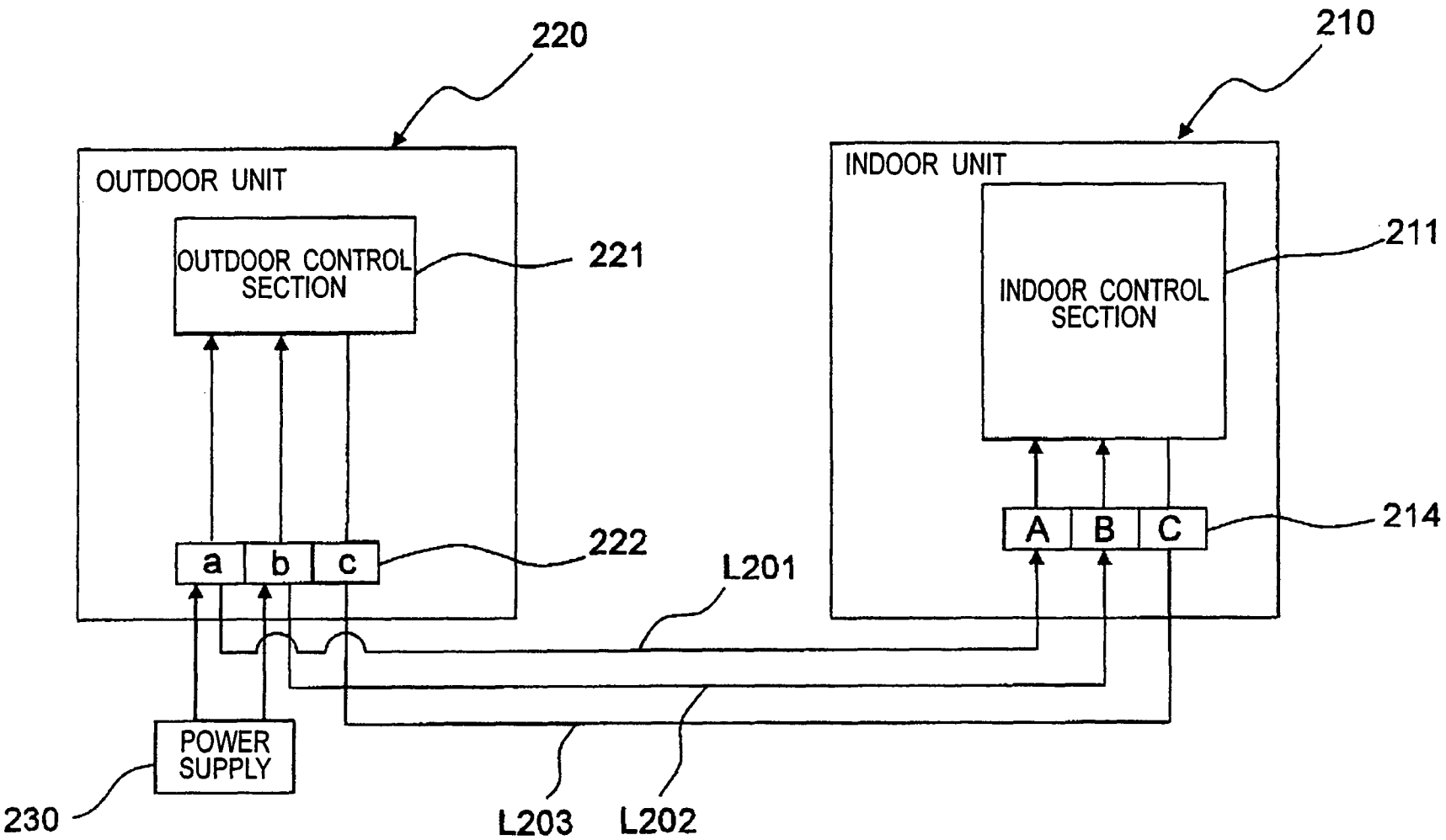
Fig.3 PRIOR ART
FIG. 3 is a configuration diagram of a separate type air conditioner according to a prior art.

FIG. 2 shows the configuration of a separate type air conditioner of the indoor power-receiving system which is a comparative example. This comparative-example separate type air conditioner, which is not of the invention, is intended for comparison with the separate type air conditioner of the embodiment of the invention.

The comparative-example separate type air conditioner shown in FIG. 2 includes an indoor unit 110 and an outdoor unit 120 as shown in FIG. 2. An indoor side terminal block 114 of the indoor unit 110 and an outdoor side terminal block 122 of the outdoor unit 120 are communicated with each other via first, second interconnection lines L101, L102, which are power-supply use interconnection lines, and a signal use interconnection line L103.

The indoor unit 110 has indoor side terminals 114A, 114B to which the first, second interconnection lines L101, L102, respectively, are connected at their one end, an indoor side terminal 114*c* to which the signal use interconnection line L103 is connected at its one end, and an indoor control section 111 to which electric power is supplied via the indoor side terminals 114A, 114B.

To the indoor control section 111, one of the power lines from a power supply 130 is connected via the indoor side terminal 114A, while the other of the power lines is connected as it is. The indoor control section 111 further has a relay 113 whose one end is connected to the other of the power lines from the power supply 130 and whose other end is connected to the indoor side terminal 114B, and a CPU (Central Processing Unit) 112. Also, the indoor control section 111 is communicated with the outdoor unit 120 via the signal use interconnection line L103 and the indoor side terminal 114*c*. By the CPU 112, the relay 113 is turned off in a standby state in which the outdoor unit 120 is stopped from operating.

Meanwhile, the outdoor unit 120 has first, second outdoor side terminals 122*a*, 122*b* to which the first, second interconnection lines L101, L102, respectively, are connected at their other end, an outdoor side terminal 122*c* to which the signal use interconnection line L103 is connected at its other end, and an outdoor control section 121 to which electric power is supplied via the outdoor side terminals 122*a*, 122*b*.

The outdoor control section 121 is communicated with the indoor unit 110 via the signal use interconnection line L103 and the outdoor side terminal 122*c*.

The indoor control section 111 of the indoor unit 110 and the outdoor control section 121 of the outdoor unit 120 are communicated with each other via the signal use interconnection line L103.

In this separate type air conditioner of the indoor power-receiving system, which is the comparative example, the relay 113 is turned off by the CPU 112 in the standby state in which the outdoor unit 120 is stopped from operating, so that the power supply to the outdoor unit 120 is stopped. However, with the constitution of this comparative-example separate type air conditioner, when the outdoor power-receiving system, in which power reception is fulfilled with the power supply connected to the outdoor unit 120, is adopted, the power supply to the outdoor control section 121 cannot be stopped in the standby state.

In contrast to this, in the separate type air conditioner shown in FIG. 1, which is the embodiment of the invention, the indoor unit 10 is enabled to control the power supply to the outdoor unit 20 while power reception is fulfilled on the outdoor unit 20 side, so that the power consumption in the standby state can be confined to the indoor unit 10 alone. Moreover, although the embodiment has been explained on a separate type air conditioner adopting the outdoor power-receiving system in which the power supply 30 is connected to the outdoor unit 20 side, yet it is also possible to adopt the indoor power-receiving system in which the power supply 30 is connected to the indoor unit 10 side as shown by dotted line in FIG. 1.

Therefore, according to the separate type air conditioner of the embodiment of the invention, control boards of the indoor unit 10 and the outdoor unit 20 can be made uniform in specifications so as to be compatible with the indoor power-receiving system. As a result, the number of types of control boards that would hitherto be given in two specifications of the indoor and outdoor power-reception systems can be lessened, and software and hardware development that have to be done only for the indoor power-receiving system specifications leads to realization of a reduction in the development cost.

Moreover, the relay 13 turned off by the CPU 12 in the standby state, in which the outdoor unit 20 is stopped from operating, does not consume electric power. Thus, the standby-state power consumption can be further reduced.

What is claimed is:

1. An air conditioner comprising:

an indoor unit; and;

an outdoor unit connected to the indoor unit via a plurality of power-supply use interconnection lines and a signal use interconnection line, the power-supply use interconnection lines including a first interconnection line, a second interconnection line and a third interconnection line, the indoor unit including first and second indoor side terminals as indoor side power-receiving terminals to which the first and second interconnection lines, respectively, are connected at their one end, a third indoor side terminal to which the third interconnection line is connected at its one end, a fourth indoor side terminal to which the signal use interconnection line is connected at its one end, a switch part with one end connected to the second indoor side terminal and another end connected to the third indoor side terminal, and a control section configured to control the switch part so as to turn off the switch part in a standby state in which the outdoor unit is kept out of operation, the outdoor unit including first and second outdoor side terminals as outdoor side power-receiving terminals to which the first and second interconnection lines, respectively, are connected at their other end, a third outdoor side terminal to which the third interconnection line is connected at its other end, and a fourth outdoor side terminal to which the signal use interconnection line is connected at its other end, and electric power being supplied to the indoor unit via the first indoor side terminal and the second indoor side terminal while electric power is supplied to the outdoor unit via the first outdoor side terminal and the third outdoor side terminal.

2. The air conditioner as claimed in claim 1, wherein the switch part does not consume electric power in an off state.

* * * * *